US006241832B1

(12) United States Patent
Miller

(10) Patent No.: US 6,241,832 B1
(45) Date of Patent: Jun. 5, 2001

(54) METHOD FOR CREEP-SIZING ANNULAR-SHAPED STRUCTURES AND DEVICE THEREFOR

(75) Inventor: Michael L. Miller, Cincinnati, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/481,170

(22) Filed: Jan. 12, 2000

(51) Int. Cl.[7] ..... C21D 8/00
(52) U.S. Cl. ..... 148/646; 72/62
(58) Field of Search ..... 148/510, 646; 72/60, 61, 62

(56) References Cited

U.S. PATENT DOCUMENTS 3,920,175 * 11/1975 Hamilton et al. ..... 72/60
3,934,441 * 1/1976 Hamilton et al. ..... 72/60
5,551,790 * 9/1996 Melton ..... 403/28

* cited by examiner

*Primary Examiner*—Scott Kastler
(74) *Attorney, Agent, or Firm*—Andrew C. Hess; Gerry S. Gressel

(57) ABSTRACT

A method and device for thermal creep-sizing an annular-shaped structure. The creep-sizing device includes a ring member with through-holes present between the inner and outer diametrical boundaries of the ring member, and with through-slots alternatingly extending from each through-hole to either the inner or outer diametrical boundary. In use, the ring member is placed within the annular-shaped structure, and pins are installed in the through-holes in the ring member to cause the outer diametrical boundary of the ring member to diametrically expand. The structure and creep-sizing device are then heated so that the mechanically expanded ring member causes the structure to undergo thermal creep-sizing.

24 Claims, 2 Drawing Sheets

METHOD FOR CREEP-SIZING ANNULAR-SHAPED STRUCTURES AND DEVICE THEREFOR

FIELD OF THE INVENTION

The present invention relates to processes and apparatuses for creep-sizing annular-shaped structures. More particularly, this invention relates to a thermal creep-sizing process that employs a mandrel configured to be installed and then expanded within a hoop structure, so that a subsequent thermal treatment diametrically expands the hoop structure as a result of thermal creep.

BACKGROUND OF THE INVENTION

Hoop structures and various other components with annular-shaped sections at times must be diametrically expanded to attain or restore desired diametrical conditions, such as during the manufacturing or reconditioning of shrouds and nozzle supports of gas turbine engines. For relatively ductile materials, sizing can be accomplished by hydraulic expansion methods while the component is at or near room temperature ("cold sizing"). However, a component can be susceptible to tensile fractures during cold-sizing if formed from certain materials, including superalloys commonly employed in gas turbine engines. For these materials, sizing must be performed at an elevated temperature. One such method is generally referred to as hot creep sizing, and involves a high mass fixture with a coefficient of thermal expansion ($\alpha$) that is relatively constant for the temperatures used and equal to or higher than the structure being sized. A difficulty with hot creep sizing is the requirement for slow and tightly controlled heating and cooling rates in order to match the growth of the fixture with the component being sized, which slows processing throughput. Another thermal creep-sizing method is known as warm sizing, and involves expanding a preheated component on a mandrel that is maintained at a lower temperature throughout the sizing operation. With many materials including superalloys, the component must be heated to very high temperatures, e.g., 1800° F. (about 980° C.) or more, which may pose a hazard to the operator.

In view of the above, it would be desirable if an improved method were available for sizing a hoop structure that avoided the disadvantages of prior art methods.

BRIEF SUMMARY OF THE INVENTION

The present invention provides a method and device for thermal creep-sizing an annular-shaped structure, including hoop structures and components with annular sections. The invention provides a method by which controlled sizing of an annular-shaped structure is achieved with a creep-sizing device that is mechanically expanded in a manner that provides controlled and accurate sizing of the structure during a thermal treatment.

According to this invention, the creep-sizing device includes a ring member having inner and outer diametrical boundaries relative to the axis of the ring member. Through-holes are present in the ring member between the inner and outer diametrical boundaries, with through-slots extending from each through-hole through the ring member to either the inner or outer diametrical boundary. Finally, pins are provided that are sized to be received in the through-holes. Each pin has a diameter approximately equal to one of the through-holes when the ring member is in a free-state, i.e., not deformed by any force applied externally to the ring member.

The method of this invention made possible by the above-described creep-sizing device generally entails placing the ring member (without pins) within an annular-shaped structure so that the outer diametrical boundary of the ring member is adjacent an inner surface of the annular-shaped structure. The pins are then inserted into the through-holes in the ring member, which causes the outer diametrical boundary of the ring member to diametrically expand. The annular-shaped structure and the device of this invention can then be heated so that the mechanically expanded ring member causes the structure to undergo thermal creep-sizing at a temperature at which the material of the structure is ductile and therefore less likely to fracture.

In view of the above, it can be seen that a significant advantage of this invention is that it entails sizing an annular-shaped structure at an elevated temperature, thereby significantly reducing the risk of tensile fractures as compared to cold sizing methods. Furthermore, the ring member employed by this invention can be of relatively low mass, and its desired sizing effect is mechanically induced instead of relying on a high coefficient of thermal expansion. As a result, the ring member can be heated relatively rapidly without stringent control of the heating and cooling rates as compared to hot creep-sizing methods. Finally, and in contrast to warm creep-sizing methods, the thermal creep-sizing method of this invention can be performed without any requirement to handle the creep-sizing device or the structure being sized while at an elevated temperature.

Other objects and advantages of this invention will be better appreciated from the following detailed description.

DETAILED DESCRIPTION OF THE INVENTION

The present invention provides a method for sizing hoop structures and various other components with annular-shaped structures, by which the structures are diametrically expanded to attain or restore desired diametrical conditions. While the invention will be described in reference to the manufacturing or reconditioning of a nozzle support of a gas turbine engine, those skilled in the art will appreciate that the invention is applicable to various other applications and components.

Figure 3:
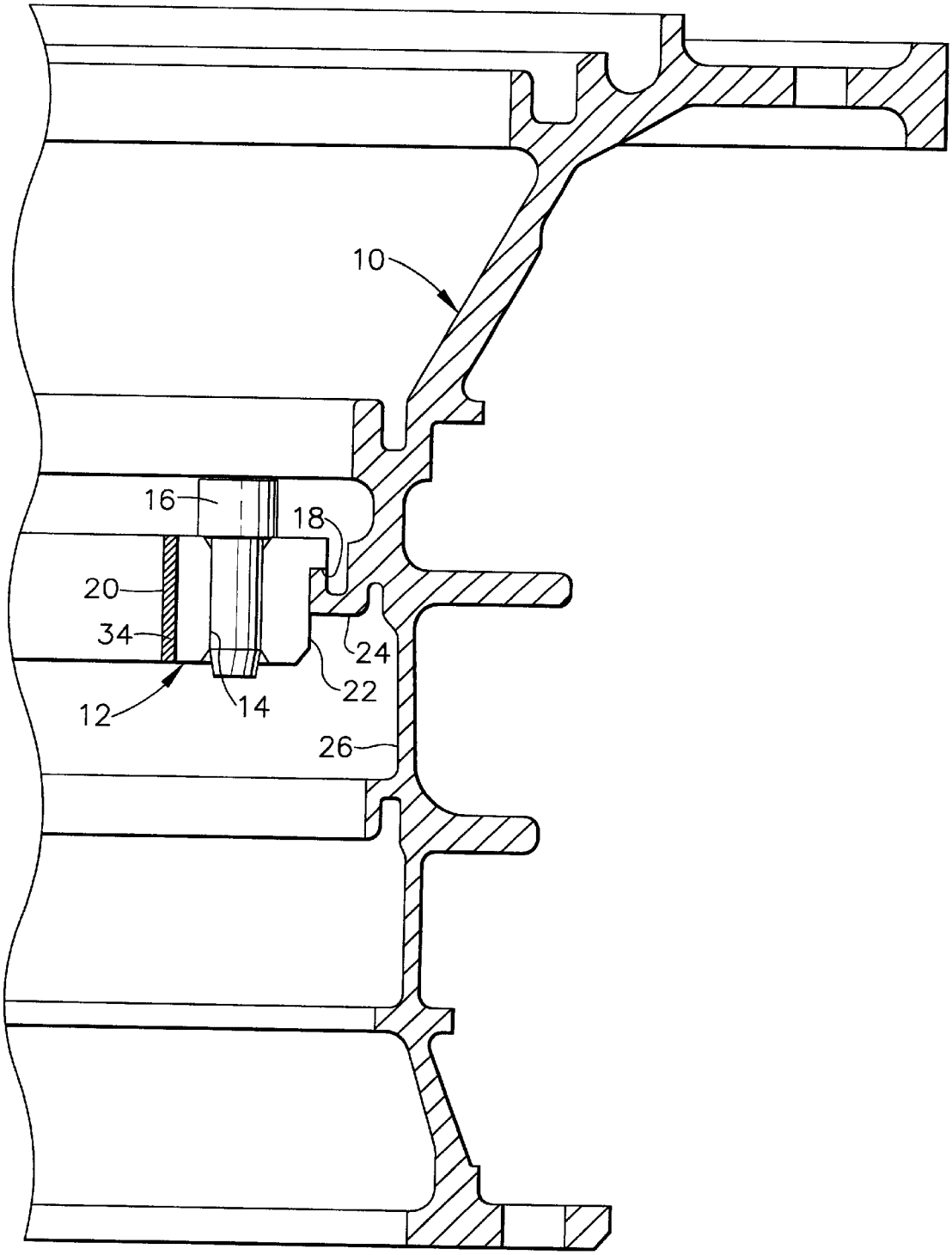
FIG. 3 is a fragmentary cross-sectional view of the mandrel of FIGS. 1 and 2 installed within a nozzle support of a gas turbine engine for expanding the nozzle support in accordance with a thermal creep-sizing method of this invention.

FIG. 3 represents a section of a gas turbine engine nozzle support 10 undergoing thermal creep-sizing in accordance with the present invention. The diameter of the nozzle support 10 is critical for its function, and therefore must be precisely sized when manufactured, as well as during reconditioning if returned from service. According to this invention, sizing of the nozzle support 10 is performed with an annular-shaped mandrel 12 having through-holes 14 in which pins 16 are installed, one of which is shown in FIG. 3. The mandrel 12 is shown as being installed entirely within the annular-shaped section of the nozzle support 10, with a shoulder 18 at an outer perimeter 22 of the mandrel 12 shown engaging a flange 24 on the interior wall 26 of the nozzle support 10.

Figure 2:
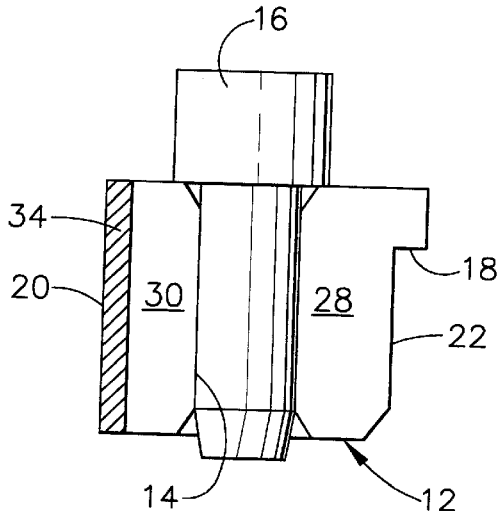
FIG. 2 represents a cross-sectional view of the mandrel of FIG. 1 with a pin installed in a through-hole within the mandrel.

FIGS. 2 and 3 show sections of the mandrel 12 in greater detail. The inner and outer perimeters 20 and 22 of the mandrel 12 are preferably circular and concentric, so that the mandrel 12 has a uniform section. In FIG. 2, the through-holes 14 can be seen as being equally spaced in the mandrel 12 midway between the inner and outer perimeters 20 and 22 of the mandrel 12. While spacing of the holes 14 may vary according to the application, a suitable spacing is roughly every five degrees over the entire circumference of the mandrel 12. The holes 14 are shown as being aligned parallel to the axis of the mandrel 12. The diameter of each hole 14 is depicted as being about one-half of the radial width of the mandrel 12, and countersunk to facilitate insertion of the pins 16. While the mandrel 12 is in a free state, i.e., undeformed by any externally-applied force, the holes 14 and pins 16 preferably have roughly the same diameter for a reason that will be explained in the discussion below.

Figure 1:
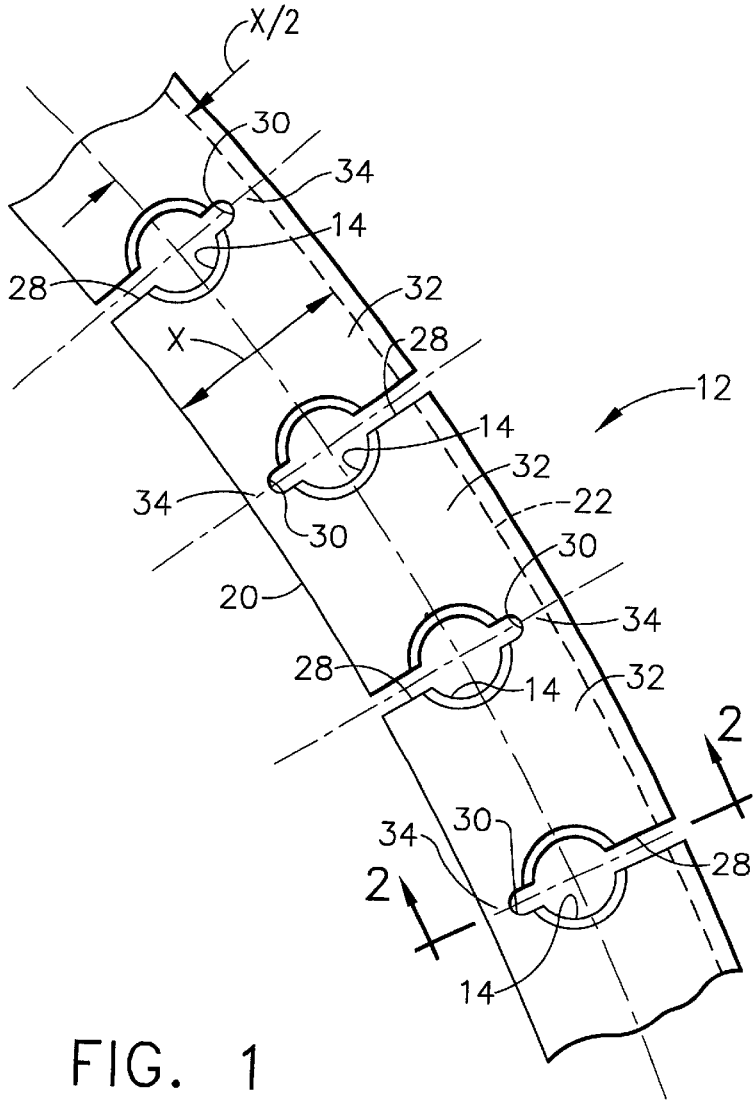
FIG. 1 is a fragmentary plan view of a mandrel for a creep-sizing device in accordance with a preferred embodiment of this invention.

A particularly important feature of the invention is the presence of slots 28 and 30 that intersect the holes 14. The slots 28 extend radially through the mandrel 12 to either the inner or outer perimeter 20 or 22, in an alternating manner as shown in FIG. 1. Similarly, the slots 30 alternatingly extend toward either the inner or outer perimeter 20 or 22 of the mandrel 12, in the opposite direction of its associated slot 28. However, the slots 30 do not penetrate completely through the mandrel 12 in the radial direction. Instead, each slot 30 is shown as extending slightly more than halfway through that portion of the mandrel 12 between its corresponding hole 14 and perimeter 20 or 22. As a result, the mandrel 12 is made up of arcuate sectors 32 held together by bridges 34 that enable the mandrel 12 to flex and diametrically contract and expand relative to its free state prior to the pins 16 being installed. However, installation of the pins 16 causes the mandrel 12 to rigidly and precisely assume an annular shape with a predetermined outer diameter.

The particular dimensions of the mandrel 12 can be varied to adapt the invention to a wide variety of uses. For sizing the superalloy nozzle support 10 represented in FIG. 1, the mandrel 12 and pins 16 are preferably formed of a wrought corrosion and heat resistant alloy, such as Inconel 718, in order to withstand the high temperatures necessary to size the support 10. To further illustrate the invention, a nozzle support of the type shown in FIG. 3 and formed of Inconel 718 might have an undersized diameter of about 75.5 cm that must be expanded to a diameter of about 75.687 cm. Such a nozzle support can be sized with a mandrel 12 having a "fixtured" outer diameter of about 75.687 to about 75.692 cm with the pins 16 installed (and having a smaller "free-state" diameter before the pins 16 are installed). A suitable radial width (the distance between the inner and outer perimeters 20 and 22) for such a mandrel 12 is about 2.54 cm, and a suitable thickness (transverse to the radial width) is about 1.3 cm. In addition, suitable diameters for the through-holes 14 and pins 16 are about 11.10 mm if the holes 14 are placed midway between the inner and outer perimeters 20 and 22 and spaced about five degrees over the entire circumference of the mandrel 12. The slots 28 and 30 preferably have widths of about 3 mm. The slots 30 preferably form bridges 34 that have a radial dimension of about 2.5 mm.

In use, the mandrel 12 (without the pins 16) is preferably coated with a suitable high-temperature anti-seize compound, and then positioned within the nozzle support 10 (or another annular-shaped structure to be sized) so that the shoulder 18 of the mandrel 12 engages the flange 24 on the inner wall 26 of the nozzle 10. Without the pins 16 in place, the mandrel 12 is able to be diametrically collapsed about 10%, more or less, and therefore can be accommodated within a cross-sectional area whose diameter is less than the free-state diameter of the mandrel 12. Consequently, the mandrel 12 can be accommodated within the nozzle support 10 even if the diameter of the support 10 is undersized by about 10%. Once the mandrel 12 is installed, pins 16 (also preferably coated with an anti-seize compound) are preferably installed in every other hole 14, and then tapped into place until the shoulder of each pin 16 contacts the mandrel 12. The remaining pins 16 are then installed in the remaining holes 14 in the same manner. As the pins 16 are inserted, the mandrel 12 tries to expand to its "fixtured" diameter as defined above, but is constrained to some degree by the nozzle support 10. If necessary, additional mandrels may be installed at different axial locations within the support 10 using the same processed outlined above to simultaneously resize other diameters of the nozzle support 10. The support and mandrel assembly is then processed through a conventional heat treat cycle, e.g., about 0.5 to about 1.5 hours at about 1800° F. (about 980° C.) or more, during which time the nozzle 10 becomes sufficiently ductile to be diametrically expanded without sustaining physical or microstructural damage. The heating and cooling rates are not as critical to the sizing operation of this invention as compared to prior art techniques. For example, a temperature difference of up to 100° F. (about 55° C.) between the mandrel 12 and nozzle support 10 is acceptable during heating and cooling to achieve the tight dimensional tolerance described above for the nozzle support 10. After cooling, the mandrel 12 can be disassembled from the resized nozzle support 10 by removing the pins 16.

While the invention has been described in terms of a preferred embodiment, it is apparent that other forms could be adopted by one skilled in the art. For example, the physical configuration of the mandrel 12 and pins 16 could differ from that shown. Therefore, the scope of the invention is to be limited only by the following claims.

What is claimed is:

1. A creep-sizing device comprising:

a ring member having an inner diametrical boundary and an outer diametrical boundary relative to an axis of the ring member;

through-holes disposed in the ring member between the inner and outer diametrical boundaries, each through-hole having a diameter;

through-slots in the ring member, each through-slot extending from one of the through-holes through the ring member to one of the inner and outer diametrical boundaries; and pins receivable in the through-holes, each pin having a diameter approximately equal to a diameter of a corresponding one of the through-holes when the ring member is in a free-state.

2. A creep-sizing device according to claim 1, wherein each through-hole has an axis substantially parallel to the axis of the ring member.

3. A creep-sizing device according to claim 1, wherein the through-slots are radial relative to the axis of the ring member.

4. A creep-sizing device according to claim 1, wherein adjacent pairs of the through-slots extend oppositely toward either the inner diametrical boundary or the outer diametrical boundary of the ring member.

5. A creep-sizing device according to claim 1, further comprising second slots in the ring member, each second slot extending from one of the through-holes into the ring member in a direction opposite to the through-slot associated with the through-hole, each of the second slots defining a bridge with an adjacent one of the inner or outer diametrical boundaries.

6. A creep-sizing device according to claim 1, wherein the inner and outer diametrical boundaries of the ring member are circular-shaped and concentric.

7. A creep-sizing device according to claim 1, wherein each if the pins is received in one of the through-holes so as to diametrically expand the outer diametrical boundary.

8. A creep-sizing device comprising:

a ring member having an inner diametrical boundary and an outer diametrical boundary relative to an axis of the ring member;

through-holes disposed in the ring member approximately midway between the inner and outer diametrical boundaries, each through-hole having a diameter and an axis substantially parallel to the axis of the ring member;

a first series of radial slots in the ring member, each of the first series of radial slots extending from one of the through-holes through the ring member to one of the inner and outer diametrical boundaries;

a second series of radial slots in the ring member, each of the second series of radial slots extending from one of the through-holes into the ring member in a direction opposite to a corresponding one of the first series of radial slots associated with the through-hole, each of the second series of radial slots defining a bridge with an adjacent one of the inner or outer diametrical boundaries; and pins receivable in each of the through-holes, each pin having a diameter approximately equal to a diameter of a corresponding one of the through-holes when the ring member is in a free-state.

9. A creep-sizing device according to claim 8, wherein adjacent pairs of the first series of radial slots extend oppositely toward either the inner diametrical boundary or the outer diametrical boundary of the ring member.

10. A creep-sizing device according to claim 8, wherein the inner and outer diametrical boundaries of the ring member are circular-shaped and concentric.

11. A creep-sizing device according to claim 8, wherein each if the pins is received in one of the through-holes so as to diametrically expand the outer diametrical boundary.

12. A creep-sizing device according to claim 8, wherein the ring member has a uniform radial width between the inner and outer diametrical boundaries and a uniform axial thickness transverse to the radial width that is less than the radial width.

13. A method for creep-sizing an annular-shaped structure, the method comprising the steps of:

placing a ring member within the annular-shaped structure so that an outer diametrical boundary of the ring member is adjacent an inner surface of the annular-shaped structure; and then inserting pins into through-holes present in the ring member and connected with through-slots to the outer diametrical boundary and an inner diametrical boundary of the ring member, the pins causing the outer diametrical boundary of the ring member to diametrically expand.

14. A method according to claim 13, wherein each through-hole is formed to have an axis substantially parallel to an axis of the ring member.

15. A method according to claim 13, wherein the pins are inserted by inserting half of the pins into every other through-holes, and then inserting the remaining pins in the remaining through-holes.

16. A method according to claim 13, wherein the through-slots are formed to be oriented radially relative to an axis of the ring member.

17. A method according to claim 13, wherein adjacent pairs of the through-slots are formed to extend oppositely toward either the inner diametrical boundary or the outer diametrical boundary of the ring member.

18. A method according to claim 13, wherein the ring member is formed to further comprise second slots therein, each second slot extending from one of the through-holes into the ring member in a direction opposite to the through-slot associated with the through-hole, each of the second slots defining a bridge with an adjacent one of the inner or outer diametrical boundaries.

19. A method according to claim 13, wherein the ring member is formed so that the inner and outer diametrical boundaries are circular-shaped and concentric.

20. A method according to claim 13, wherein each pin has a diameter approximately equal to a diameter of a corresponding one of the through-holes when the ring member is in a free-state and prior to placing the ring member in the annular-shaped structure.

21. A method according to claim 13, further comprising the step of heating the annular-shaped structure for a duration sufficient to diametrically expand the annular-shaped structure.

22. A method for creep-sizing an annular-shaped structure of a gas turbine engine, the method comprising the steps of:

providing a ring member comprising:

an inner diametrical boundary and an outer diametrical boundary relative to an axis of the ring member;

through-holes disposed in the ring member approximately midway between the inner and outer diametrical boundaries, each through-hole having a diameter and an axis substantially parallel to the axis of the ring member;

a first series of radial slots in the ring member, each of the first series of radial slots extending from one of the through-holes through the ring member to one of the inner and outer diametrical boundaries; and a second series of radial slots in the ring member, each of the second series of radial slots extending from one of the through-holes into the ring member in a direction opposite to a corresponding one of the first series of radial slots associated with the through-hole, each of the second series of radial slots defining a bridge with an adjacent one of the inner or outer diametrical boundaries;

providing pins having diameters that are approximately equal to diameters of the through-holes when the ring member is in a free-state;

placing the ring member within the annular-shaped structure so that the outer diametrical boundary of the ring member is adjacent an inner surface of the annular-shaped structure;

inserting half of the pins into every other through-hole, and then inserting the remaining pins in the remaining through-holes so as to diametrically expand the outer diametrical boundary of the ring member; and then heating the annular-shaped structure for a duration sufficient to diametrically expand the annular-shaped structure.

23. A method according to claim 22, wherein adjacent pairs of the first series of radial slots are formed to extend oppositely toward either the inner diametrical boundary or the outer diametrical boundary of the ring member.

24. A method according to claim 22, wherein the ring member is formed so that the inner and outer diametrical boundaries are circular-shaped and concentric.

* * * * *